US005566540A

United States Patent [19]

Bertrams et al.

[11] Patent Number: 5,566,540

[45] Date of Patent: Oct. 22, 1996

[54] TRANSPORT ASSEMBLY IN A RING SPINNING MACHINE WITH DRIVEN CONVEYOR BELTS FOR DELIVERING EMPTY TUBES AND FOR REMOVING COPS DISPOSED ALONG SPINDLE ROWS AT THE MACHINE

[75] Inventors: Josef Bertrams, Wegberg; Moritz O. Weich, Dresden, both of Germany

[73] Assignee: W. Schlafhorst AG & Co., Mönchengladbach, Germany

[21] Appl. No.: 257,360

[22] Filed: Jun. 9, 1994

[30] Foreign Application Priority Data

Jun. 9, 1993 [DE] Germany ..... 43 19 173.8

[51] Int. Cl.[6] ..... D01H 9/10; D01H 9/14

[52] U.S. Cl. ..... 57/281; 57/90; 242/35.5 A; 242/130.3

[58] Field of Search ..... 242/35.5 A, 130.3; 198/465.2, 465.1; 57/90, 281, 277

[56] References Cited

PUBLICATIONS

Japanse Patent Abstract No. 62–257429, Fukuda, dated Nov. 10, 1987.

*Primary Examiner*—William Stryjewski

*Attorney, Agent, or Firm*—Herbert L. Lerner; Laurence A. Greenberg

[57] ABSTRACT

An assembly for transporting empty tubes and cops in a ring-spinning machine. Driven conveyor belts are disposed alongside rows of spindles disposed on both sides of the ring-spinning machine. The conveyor belts are driven for delivering empty tubes to and removing cops from the spindles, and the conveyor belts have openings formed therein at a mutual spacing approximately corresponding to half the given spindle spacing for securing arbors for alternatingly supporting empty tubes and cops. Instead of the arbors, however, at least every other opening supports a driver which engages one of a plurality of caddies at an indentation formed in a support surface thereof and entrains it along the conveyor belt. Each of the caddies carry an arbor for an empty tube and for a cop. The caddies have a length which is less than the given spindle spacing. Guide tracks extend along the conveyor belts and they guide the caddies along the conveyor belts.

9 Claims, 3 Drawing Sheets

TRANSPORT ASSEMBLY IN A RING SPINNING MACHINE WITH DRIVEN CONVEYOR BELTS FOR DELIVERING EMPTY TUBES AND FOR REMOVING COPS DISPOSED ALONG SPINDLE ROWS AT THE MACHINE

BACKGROUND OF THE INVENTION

Field of the Invention

The invention relates to a ring spinning machine in which conveyor belts drivable for delivering empty tubes and removing cops are disposed along spindle rows present on both sides of the machine, the conveyor belts having openings at half the spindle spacing for receiving arbors for cops and empty tubes in alternation.

A ring-spinning machine of this generic type is known for example from German published, non-prosecuted application DE-OS 20 45 263. An essential characteristic of such a ring-spinning machine is that conveyor belts are disposed on both sides of the machine along the rows of spindles. The conveyor belts deliver empty tubes to the spinning machine and remove cops therefrom. The conveyor belts have openings at half the spindle spacing at which alternatingly arbors for cops and for empty tubes are secured. Typically, the arbors are secured in these openings by screw fastening means. One advantage of this is that in doffing, an intermediate position for the empty tubes is not required. Thus the full cops are first removed from the spindles by the doffer and placed directly on the arbors, intended for that purpose, between the empty tubes that are located on the respectively other arbors. Immediately after that, by indexing the conveyor belts onward by one-half the spindle spacing, the empty tubes are positioned under the grippers of the respective doffer. The doffer can then immediately grasp these empty tubes and place them on the empty ring spindles. This doffing process can be achieved very reliably and quickly. However, in this embodiment, the transport path of the cops and tubes is bound to the transport path of the respective conveyor belts.

To overcome that bound condition, it has heretofore been proposed in European patent publication EP 0 410 121 B1 to provide slideways all around the ring-spinning machine, on which, by means of a conveyor chain having drivers, caddies independent of one another (transport plates) can be displaced. These caddies can be spun out of this transport loop along with the cops or tubes placed on them. The center spacing of the caddies is equivalent to the spindle spacing. To enable carrying out the doffing operation, additional spindles are also present on the drivers. In the doffing process, the tubes first removed from the caddies have to be transferred to this intermediate position so that the arbors of the caddy will be freed for mounting the removed cops on them. Then the doffer must take over the "temporarily stored" empty tubes and mount them on the ring arbors. This doffing operation is more complicated than the one described in the above-noted German publication 20 45 263.

European published, non-prosecuted application EP 0 355 887A1 describes a spinning machine in which the intermediate position is avoided by using caddies with two arbors. These caddies are coupled to one another, resulting in one coherent train. However, that cancels out the mutual independence of the caddies. Above all, it becomes problematic to control this coherent caddy train if it is used in ring-spinning machines with more than 40 spinning stations, as in the exemplary embodiment of EP 0 355 887 A1, as for example 1000 or more. Above all, because dimensional deviations add up, by the end of the train there can be such a difference in spindle spacing that major damage can occur in the doffing process.

The same problem arises if, as in the example in Japanese patent application 64-28175, a pusher unit of caddies coupled together in pairs is formed.

The Japanese patent abstract JP 62-257429 pertains to a conveyor belt with entraining members 12 which engage in relatively large openings at the bottom of peg trays. The spindle spacing of the spinning machine corresponds to the diameter of the peg trays. Accordingly, the transport system cannot be utilized in doffing systems without intermediate storage of the empty tubes.

SUMMARY OF THE INVENTION

It is accordingly an object of the invention to provide a transport system in a ring-spinning machine for transporting empty tubes to and cops from a row of spindles, which overcomes the hereinafore-mentioned disadvantages of the heretofore-known devices of this general type and which further develops the above-noted generic ring-spinning machine in such a way that a more-flexible transport system is created. It is moreover an object of the invention to provide an assembly which is applicable to retrofitting conventional transport systems of ring-spinning machines in which conveyors are provided with openings to which arbors for the tubes and the cops are directly attached.

With above and other objects in view there is provided, in accordance with the invention, an assembly for transporting empty tubes and cops in a ring-spinning machine having rows of spindles disposed on both sides thereof at a given spindle spacing. The assembly comprises driven conveyor belts disposed alongside the rows of spindles of the ring-spinning machine, the conveyor belts being drivable for delivering empty tubes to and removing cops from the spindles, the conveyor belts having openings formed therein at a mutual spacing approximately corresponding to half the given spindle spacing; a plurality of caddies each carrying an arbor for receiving an empty tube and an arbor for receiving a cop; each of the caddies having a length being less than the given spindle spacing; and each of the caddies having an indentation formed in a bottom surface thereof; guide tracks extending along the conveyor belts for guiding the caddies on the conveyor belts; driver members secured in at least every other one of the openings of the conveyor belts, the driver members engaging in the indentations formed in the bottom surface of each of the caddies for transporting the caddies in a form-locking manner. The openings formed in the conveyor belts are openings which receive arbors for cops and empty tubes in alternation in the original configuration. Additionally, the arbors removed from the conveyor belts may be reused in the retrofitted assembly and secured to the caddies.

The novel invention described herein makes it possible to retrofit generic ring-spinning machines with a more flexible transport system, having mutually independent caddies, at reasonable expense. The conveyor belts, on which the openings for securing the arbors are present at half the spindle spacing, can remain together with their drive in the ring-spinning machine. The only additional requirement includes guideways or guide tracks for guiding the caddies along the conveyor belts. These guides have a C-shaped cross sections whose openings face one another. The openings in the conveyor belts, which are adapted in their spacing precisely to the spindle spacing, are used to receive drivers or entraining members. As a result, without further provisions, the drivers likewise have precisely the spindle spacing relative to one another. At the maximum length of the caddies according to the invention, which is less than the spindle spacing, the respective disposition of the caddies along the spindle rows is determined solely by the spacing among the drivers. Dimensional deviations in the caddies from soiling, deformation or the like remains without any influence on adhering to the spacing. Above all, dimensional deviations are prevented from adding up.

Although it is not precluded that caddies may be provided alternatingly for cops and empty tubes, and that drivers are disposed for that purpose in all the openings of the conveyor belts, this would make the stability of such caddies extremely low. Their base plates could then, given a spacing of 70 mm, have a maximum diameter of less than 35 mm, for instance, and would thus even be less than the winding diameter of the cops. By comparison, larger caddies with both types of arbors do provide for major advantages in terms of stability.

By disposing the drivers in accordance with the spindle spacing, in combination with the fact that the caddies do not strike one another during transport, it is also possible to use one and the same caddy size for different spinning machine spacings. For instance, caddies with a length of 69 mm are usable for spinning machines with a spindle spacing of 70 and 75, without further ado. All that needs to be done is to take care so that the further indexing of the conveyor belts during the doffing operation after placement of the cops can be done only by an amount that is equivalent to the center spacing between the arbors on the caddies which deviates from the otherwise usual half spindle spacing.

In accordance with another feature of the invention, the assembly includes transverse transport paths extending between the guide tracks and joining together the guide tracks for forming a closed loop.

To enable fully exploiting the advantages of flexibility of the transport system, the transport path should be embodied completely as a closed loop. This makes it possible to exchange cops for empty tubes at a transfer region, for example a region of contact with transport paths of the bobbin winding machine. In this way, at the same time, the removal of the cops from the ring-spinning machine and resupplying it with empty tubes are attained. Compared with the method that is usual for the generic ring-spinning machines, the initially complete doffing of all the cops and subsequent delivery of the empty tubes to the same end of the machine after a reversal of the direction of motion of the conveyor belts produces a considerable time saving. The known method, particularly at small cop dimensions (higher exchange frequency), can lead to considerable time problems.

It has already been attempted, for instance in German published application DE-OS 28 15 105, to bypass this disadvantage by transporting the empty tubes across the entire ring-spinning machine to its other end, to enable delivering them simultaneously with the cop removal that takes place at the opposite end. However, this empty tube transport path extending across the spinning machine is difficult to monitor and can lead to considerable problems, because of poor accessibility, in the event of trouble such as backups, seizing and the like. Conversely, in the present invention, the accessibility of the transport paths of the cops and tubes is assured continuously.

In accordance with an added feature of the invention, the driver members each have a driver member length defined along a transport direction of the conveyor belts and the indentations formed in the caddies have an indentation length defined along the transport direction, the driver member length and the indentation length being adapted to one another so as to ascertain proper engagement of the driver members in the indentations. Preferably, the driver member length is slightly less than the indentation length.

The play between drivers and indentations in the caddies that is averted in the context of the invention means not only that the spacing accuracy is adhered to exactly, but an arbitrary transport direction of the caddies is also permitted. This further increases the flexibility of the system.

In accordance with an additional feature of the invention, the caddies comprise substantially rectangular base plates, the base plates having bores formed therein for receiving the arbors, the bores corresponding to the openings in the conveyor belts.

In accordance with a further feature of the invention, the assembly includes means disposed at one of the crosswise transport paths for exchanging cops against empty tubes, such as for instance a change-over device.

In accordance with again a further feature of the invention, the assembly further includes storage belts for cueing caddies. The storage belts, which preferably transport the caddies by slaving friction, are disposed between an end of a respective one of the conveyor belts and the transverse transport path at which the cops are exchanged for empty tubes.

In accordance with a concomitant feature of the invention, the assembly includes pusher means disposed at respective ends of the transverse transport paths for displacing the caddies onward in a transport direction by a distance corresponding to a width and to the length, respectively, depending on the required transport direction.

The expense for retrofitting a generic ring-spinning machine in accordance with the present invention can be reduced markedly still further by reusing the arbors, which were previously secured to the conveyor belts, for the caddies. All that needs to be done then is to expand the base plates of the caddies.

In order to dissolve the form-locking and thus forced driving of the caddies, as caused (at least in the region in which the exchange between cops and empty tubes takes place) by the entraining drivers, storage conveyor belts that adjoin the existing conveyor belts are provided. The storage conveyor belts transport the caddies solely by frictional engagement. As a result, their mutual spacing is no longer fixed, and the drive of the conveyor belts can take place continuously, or in other words not intermittently.

Displacement devices or change-over devices at the ends of the transverse transport paths are advantageous because the direction of caddy transport is changed by 90° without changing the orientation of the caddies.

Other features which are considered as characteristic for the invention are set forth in the appended claims.

Although the invention is illustrated and described herein as embodied in a transport assembly in a ring-spinning machine with driven conveyor belts for delivering empty tubes and removing cops disposed along spindle rows at the spinning machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
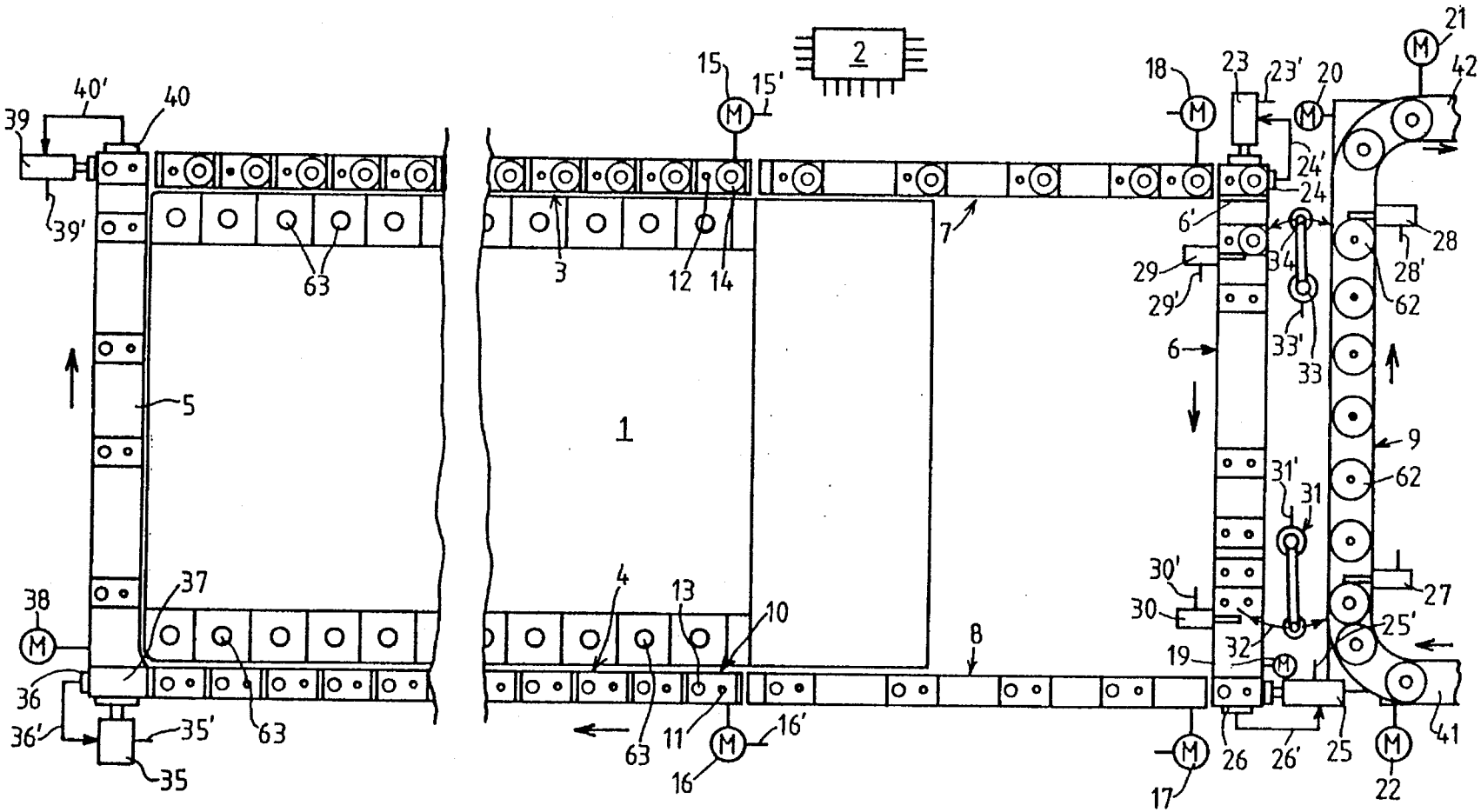
FIG. 1 is a schematic top-plan view of a transport loop for the caddies in a ring-spinning machine, including an exchange region for the cops and empty tubes, to a bobbin winder machine loop.
Figure 2:
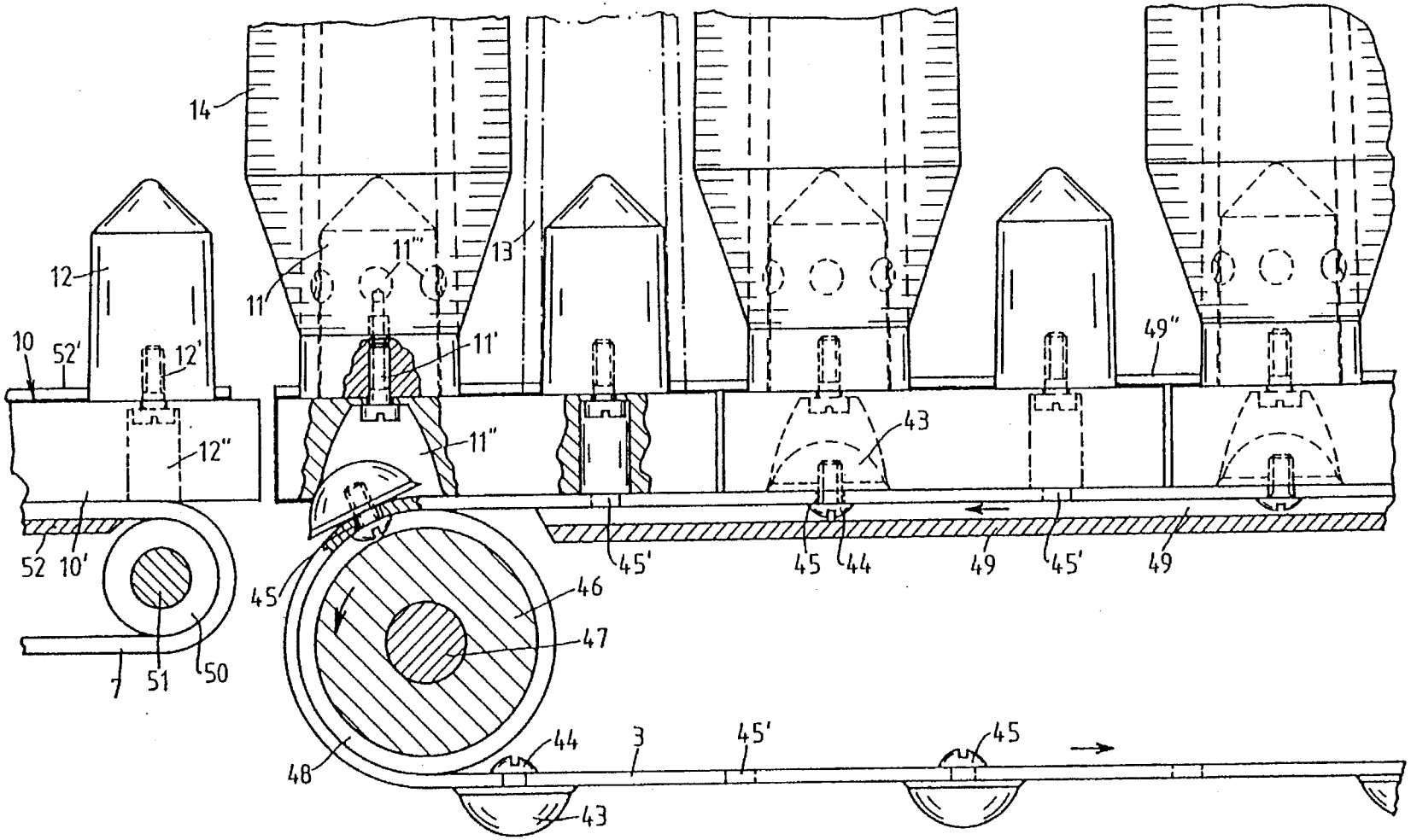
FIG. 2 is a side view of a detail of a transport path in the region where a transition occurs from the form-locking transport of the caddies to the frictional transport in which the caddies are transported by slaving friction.

Referring now to the figures of the drawing in detail and first, particularly, to the essentially schematic illustration of FIG. 1 and to FIG. 2, there is seen the entire transport loop of a ring-spinning machine 1 according to the invention. The various stages in the transport sequence are synchronized with one another by a central control unit 2. The conveyor belts 3 and 4 are those that were already originally present in the ring-spinning machine now retrofitted according to the invention. The spindles or arbors 11 for cops 14 and arbors 12 for empty tubes 13, which arbors were originally secured in openings 45 and 45' (FIG. 2), are now secured on caddies 10. The base plates 10' of the caddies 10 have bores 11" and 12" through which screws 11' and 12' can be passed in order to secure the arbors 11 and 12, respectively. This securing of the arbors 11 and 12 is accordingly essentially equivalent to how they were secured previously in the respective conveyor belt 3 or 4.

The bore 11" for the screw 11' of the arbor 11 is widened toward the bottom in the form of a rounded-off indentation. This widening serves the purpose of receiving entrainers or drivers 43, which are secured to the conveyor belt 3 by means of screws 44. The screws 44 are passed through the openings 45, which were used originally to secure the arbors 11 directly. The openings 45, and thus the drivers 43, are disposed at a distance from one another which corresponds to a spindle spacing S of spindle row of the ring-spinning machine The openings 45', which served originally to secure the arbors 12, are not used in this exemplary embodiment, because the guidance of the caddies is intrinsically adequately assured by one driver 45 each. However, it is not precluded by the invention that the openings 45' may also be occupied with drivers which could engage suitably embodied bores 12" for the arbors 12.

The engagement of the drivers 43 in the indentations 11" is a form-locking engagement. A form-locking connection is herein defined as one which connects two elements together due to the shape of the elements themselves, as opposed to a force-locking connection, which locks the elements together by force external to the elements. Force-locking, in this context, is also referred to as frictional engagement or friction slaving.

The arbors 11 are provided with resilient knobs 11'" for securingly holding the cops 14. For the tubes 13, which have a substantially lower weight, simple arbors 12 are considered to be adequate. However, as already noted, the embodiment of the arbors 11 and 12 is equivalent to their usual embodiment, because they can be re-used when the transport system is refitted according to the invention.

As also seen in FIG. 2, a guide track 49 provides exact guidance of the caddies 10 and in particular their base plates 10'. The guide track 49 extends along the conveyor belts 3. This guide track 49 has an essentially rectangular channel cross section, which is open at the top and on the bottom has a groove 49'. The opening 49" on the top serves to allow the passage of the arbors 11 and 12 of the caddies 10, while the groove 49' is required for the free passage of the heads of the screws 44. The cover plate of the guide track 49, interrupted by the opening or slit 49" serves essentially to prevent tilting of the caddies 10. The parts of the guide track 49 disposed on the underside on either side of the groove 49' serve as a bearing surface for the conveyor belt 3.

The conveyor belt 3 is deflected by a deflection roller 46 that is driven by a motor 15 (FIG. 1) via a drive shaft 47. Analogously to the guide track 49, the deflection roller 46 has a groove 48, which permits the free passage of the heads of the screws 44.

In the transport direction, the conveyor belt 3 is adjoined by a further conveyor belt 7, which is deflected by a deflection roller 50 that in turn is supported by a bearing axle 51. The conveyor belt 7 is continuously driven by a motor 18 (FIG. 1), while the conveyor belt 3 and the conveyor belt 4 on the opposite side of the ring-spinning machine 1 are driven discontinuously. The belt 7 may be referred to as a storage belt which cues up the caddies (10) until they are received at a platform 6'.

In the region of the conveyor belt 7, there is also a guide track 52, which with its underside supports the upper run of the conveyor belt 7 and with its top, forming a guide slit 52' for the passage of the arbors 11 and 12, prevents tilting of the caddies 10.

In FIG. 2, a tube 13 mounted on an arbor 12 is shown in dash-dotted lines between two cops. This is merely intended to demonstrate that the spacing of the arbors must be chosen such that a tube 13 can be positioned between the cops 14 without contacting them. As already described above, this is a requirement for the doffing operation, since the cops 14 are mounted by the doffer between the tubes 13 that are still located on their arbors 12. In the transport phase, which is illustrated in FIG. 2, naturally there are no longer any tubes 13 on the arbors 12.

Figure 3:
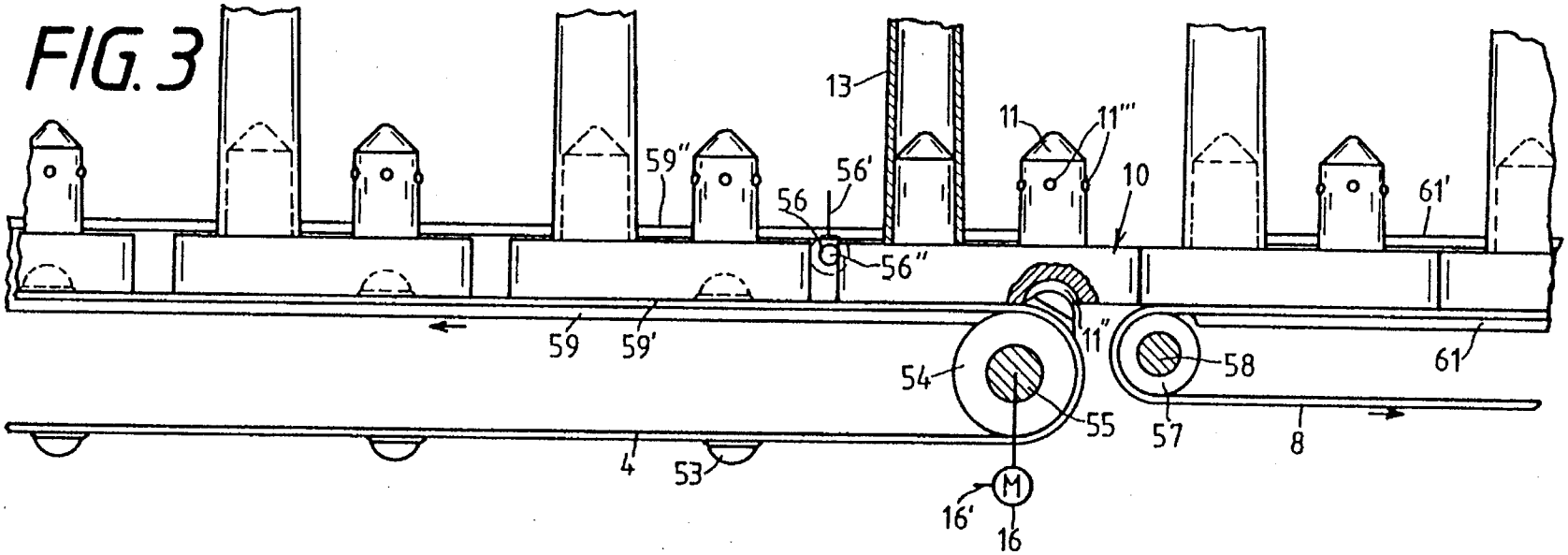
FIG. 3 is a side view of the opposite transition region, in which the caddies are taken over from the frictional transport means to the form-locking transport means, in one embodiment of the invention.
Figure 4:
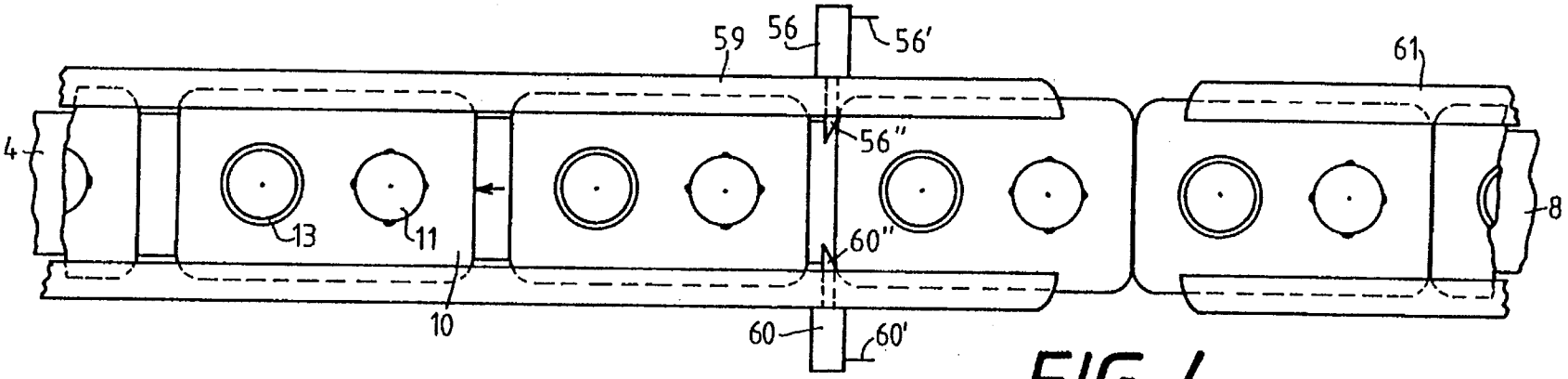
FIG. 4 is a top-plan view corresponding to FIG. 3.

In FIGS. 3 and 4, the transfer of the caddies 10 from a continuously transporting conveyor belt 8 onto the discontinuously transporting conveyor belt 4 is shown. The conveyor belt 4 is embodied analogously to the conveyor belt 3 and is therefore shown in simplified form. Only the drivers, here identified by reference numeral 53, can be seen. Here, a guide track 59 has a groove 59' on its underside and guide slit 59" on the top as well as cover plates for preventing tilting of the caddies 10. It should also be emphasized that the mutual spacing of the caddies is chosen to be greater than in the view of FIG. 2. Accordingly, this example, unlike the view of FIG. 2, involves a spinning machine having a larger spindle spacing. The spindle 63, spacing could be 70 mm in FIG. 2 for instance while in the example of FIGS. 3 and 4 it is 75 mm. Nevertheless, caddies 10 having the same dimensions, such as 68 mm or 69 mm, are used.

This is unproblematic with respect to the doffing operation, since the drivers 53 and the arbors 11 for the cops 14, the arbors being located with their center axis vertically above the drivers, are positioned identically. Compared with the original spacing of the arbors 12 (half the spindle spacing), this spacing here is shortened by a few millimeters. Nevertheless, this can easily be compensated for by correspondingly shortening the transport paths during the doffing operation (position of the tubes under the grippers of the doffer after the removal of the cops). This can be achieved by the drive of the motor 16 or on the opposite side of the motor 15, both of which are controlled with the central control unit 2.

The spacing among the caddies 10 on the side of their removal from the conveyor belt 3 is unproblematical, especially if the conveyor belt 7 is driven somewhat faster than the conveyor belt 3. On the opposite side, care must be taken to assure that the corresponding spacings are brought about upon transfer to the conveyor belt 4 if the caddies 10 directly abut the conveyor belt 8. To that end, stoppers 56 and 60 are provided, which are likewise triggered by the central control unit 2, via control lines 56' and 60'. The stoppers are activated once the end faces of two successive caddies 10 are positioned precisely at the level of these stoppers. In that position, it is advantageous to stop the conveyor belt 4. With the penetration of beveled rams or push rod stops 56" and 60" between the successive caddies 10, a spacing is initially created that is equivalent to the thickness of the rams. Immediately thereafter, the conveyor belt 4 is restarted, and the rams 56" and 60" are retracted, in a manner adapted to the requisite spacing among the caddies 10. This position must be chosen such that the arriving driver 53 can unproblematically penetrate into the bore 11', which is embodied as a round indentation. It should be noted that the driver 53 and the indentation have only such slight differences in dimension that unhindered penetration of the driver 53 into the indentation is assured. Any play that goes beyond that might possibly cause inaccuracies.

In addition to the fact that in the present example the penetration of the rams between the caddies is made easier by rounding of the edges thereof, it is also advantageous to round these edges off for overall purposes of manipulating the caddies. It is moreover possible to chamfer the lower edges of the caddies, so that at the transition of the caddies from one transport segment to another any steps that might be present can be unproblematically overcome. This provision is readily understood and has therefore not been specifically illustrated in the drawing.

The use of the same caddies for different spinning machine spacings provides corresponding advantages in manufacture and in spare parts warehousing, since only one, or in the case of major spacing differences at most two, different caddy sizes need to be available.

It can also be seen in FIGS. 3 and 4 that a guide track 61, which has a guide slit 61' on its top, is also disposed in the region of the continuously driven, supplying conveyor belt 8.

FIG. 1 shows a situation in which the ring-spinning machine 1 has had half its cops removed or has been half re-supplied with its empty tubes. By the intermittently driven conveyor belt 3, the caddies 10 are successively supplied to the conveyor belt 7 that is driven continuously at a somewhat higher speed. This conveyor belt 7 transports the caddies 10 as far as the platform 6' of the transverse transport path 6. The frontmost caddy 10 at a given time is pushed all the way onto this platform 6' by the pressure from behind of the following caddies. A sensor 24 detects this arrival and via a control line 24 switches a ram 23, which is operated by means of a fluid cylinder, for instance. By means of this ram 23, the caddy 10 standing on the platform 6' is displaced by one caddy spacing onto a conveyor belt of the transverse transport path 6, which is driven in the direction of the arrow by means of a motor 19. This conveyor belt feeds this caddy against a stopper 29 that stops it. The stopper 29 may be coupled with non-illustrated sensor, in order to check whether a caddy has arrived.

Disposed next to the stopper is a change-over device 33 whose gripper head 34 engages the cop 14 positioned on the caddy 10 and moves it to a caddy 62 of the bobbin winding machine loop. Change-over devices of this kind are well-known and so a more-detailed description thereof can be dispensed with for the purpose of this disclosure. The now empty caddy 10 is transported by the aforementioned conveyor belt along the transverse transport path 6 up to a further stopper 30 where it is stopped. With its gripper head 32, a change-over device 31 located at that point takes an empty tube 13 from a caddy 62 of the bobbin winding machine and places it onto the corresponding arbor 12 on the caddy 10 located at the stopper 30. The configuration and dimensioning of the change-over 31 and in particular the swivel radius of the gripper head 32 is chosen accordingly, as can be seen from FIG. 1.

On the bobbin winding machine side, the caddies 62 are delivered to the transport path 9 located parallel to the transverse transport path 6 of the ring-spinning machine loop by a conveyor belt 41, which is driven by a motor 22. A conveyor belt extending along this transport path 9 is driven continuously by a motor 20. First, the caddies 62 with empty tubes 13 are backed up by a stopper 27. The first caddy 62 at a given time at the stopper 27 is ready for removal of the empty tube 13 positioned at it, which as already noted is engaged by the gripper head 32 of the change-over device 31. The caddies 62 released by the stopper 27 are then ready for receiving a cop 14. To that end, they are stopped by a stopper 28 in a position in which the gripper head 34 of the change-over device 33 can mount a cop 14 that has been taken over from the ring-spinning machine 1. Once the cop 14 is in place, the stopper 28 releases the caddy 62, which is then delivered to a transport path 42 whose conveyor belt is driven by a motor 21 in the direction of the arrow. The transport path 42 merges with a delivery path to the bobbin winding machine.

The caddies 10 released by the stopper 30 along the crosswise transport path 6 travel until they enter the region of a ram 25, where they are stopped by a non-illustrated stop. A sensor 26 detects the arrival of the caddy 10 and transmits the information to the ram actuator 25 via an information line 26'. This pusher 25 becomes active and displaces the caddy 10 onto the conveyor belt 8, which is continuously driven by a motor 17. The conveyor belt 8 feeds the caddies 10 as far as the conveyor belt 4. The transfer of the caddies 10 to this conveyor belt 4 has already been described above.

A platform 37 is provided at the end of the conveyor belt 4 as seen in the transport direction. The caddies 10 are pushed onto the platform 37. The length of the platform 37 and the pulsed operation of the conveyor belt 4 should be adapted to one another such that one caddy 10 at a time is pushed all the way onto the platform 37 once the conveyor belt 4 is stopped again. Although intrinsically this assures secure positioning of the respective caddy 10 on the platform 37, a sensor 36 may also be provided at that point. The sensor 36 is connected to a ram 35 via an information line 36'. After the arrival of the caddy 10 in the appropriate position on the platform 37, the ram 35 is actuated and displaces this caddy 10 onto the conveyor belt of a transverse or crosswise transport path 5. This conveyor belt is driven in the direction of the arrow by a motor 38. On this crosswise transport path 5, the caddies 10 are transported until they reach a non-illustrated stop next to a ram 39. Here as well, a sensor 40 detects the arrival of a caddy 10 and reports that to the ram 39 via an information line 40'.

By means of the central control unit 2, the motor 15 and thus the intermittent drive of the conveyor belt 3 should be adapted to the activity of the ram 39 in such a way that the caddy 10 to be displaced onto the conveyor belt 3 is displaced so exactly onto this conveyor belt 3 that a driver precisely meets the indentation intended for it in the caddy 10. In the event that a new caddy 10 has not yet arrived at the ram 39, which the sensor 40 has detected, then the drive of the motor 15 must also be suppressed until a new caddy 10 arrives.

Because of the continuous drive of the conveyor belts 7 and 8 among others, the compulsory cadence of the intermittent drive in the region of the conveyor belts 3 and 4 is interrupted, so that it is unnecessary to adapt all the motions in the entire loop to one another.

As will be appreciated, the motors 15 and 16 are coupled to the central control unit 2 by control lines 15' and 16', respectively. The rams are likewise coupled to the center control unit 2, that is, ram 23 via a control line 23' ram 25 via a control line 25' ram 35 via a control line 35' and ram 39 via a control line 39'. As a result, the possibility exists of varying the transport loop and fully adapt each of the steps.

The stoppers 27 and 28 of the bobbin winding machine loop are likewise connected to the central control unit 2 via control lines 27' and 28', and the stoppers 29 and 30 are so connected via control lines 29' and 30, as are the change-over lifters 31 and 33 via control lines 31' and 33'. As a result, the activity of the stoppers at a given time for positioning the various caddies can be adapted to the activity of the change-over lifters. Instead of the connection with the central control unit, it is also possible, however, for each of the two change-over lifters to be coupled to the immediately adjacent stoppers for coordinating these stoppers.

In the event that the ring-spinning machine 1 is to be coupled with a different bobbin winding machine, in which the transport loop is in the opposite direction, the possibility also exists of changing the transport direction in the loop of the ring-spinning machine, by making only a few changes relative to the configuration shown in the drawings. The driving direction is of no particular significance because of the slight play of the drivers relative to the indentations of the caddies 10. The arrangement of displacement devices and stoppers must merely be changed, and the directions of rotation of the motors reversed. The spatial orientation of the caddies does not change anyway, and so here as well no additional provisions are necessary.

We claim:

1. In a ring-spinning machine having rows of spindles disposed on both sides thereof at a given spindle spacing, an assembly for transporting empty tubes and cops, which comprises:

two separate, driven conveyor belts disposed alongside the rows of spindles of the ring-spinning machine, said conveyor belts being independently drivable for delivering empty tubes towards and moving cops away from the spindles, said conveyor belts having openings formed therein at a mutual spacing approximately corresponding to half the given spindle spacing;

a plurality of caddies each carrying an arbor for receiving an empty tube and an arbor for receiving a cop; each of said caddies having a length being less than the given spindle spacing; and each of said caddies having an indentation formed in a bottom surface thereof;

guide tracks extending along said conveyor belts for guiding said caddies on said conveyor belts;

driver members secured in at least every other one of said openings of said conveyor belts, said driver members engaging in said indentations formed in the bottom surface of each of said caddies for transporting said caddies in a form-locking manner.

2. The assembly according to claim 1, further comprising transverse transport paths extending between said guide tracks and joining together said guide tracks for forming a closed loop.

3. The assembly according to claim 2, further comprising means disposed at one of said tranverse transport paths for exchanging cops for empty tubes.

4. The assembly according to claim 3, further comprising storage belts for cueing caddies disposed between an end of a respective one of said conveyor belts and said transverse transport path at which the cops are exchanged for empty tubes.

5. The assembly according to claim 1, wherein said driver members each have a driver member length defined along a transport direction of said conveyor belts and said indentations formed in said caddies have an indentation length defined along the transport direction, said driver member length and said indentation length being adapted to one another so as to ascertain proper engagement of said driver members in said indentations.

6. The assembly according to claim 5, wherein said driver member length is slightly less than said indentation length.

7. In a ring-spinning machine having rows of spindles disposed on both sides thereof at a given spindle spacing, an assembly for transporting empty tubes and cops, which comprises:

driven conveyor belts disposed alongside the rows of spindles of the ring-spinning machine, said conveyor belts being drivable for delivering empty tubes towards and moving cops away from the spindles, said conveyor belts having openings formed therein at a mutual spacing approximately corresponding to half the given spindle spacing;

a plurality of caddies each carrying an arbor for receiving an empty tube and an arbor for receiving a cop; each of said caddies having a length being less than the given spindle spacing; and each of said caddies having an indentation formed in a bottom surface thereof;

guide tracks extending along said conveyor belts for guiding said caddies on said conveyor belts;

driver members secured in at least every other one of said openings of said conveyor belts, said driver members engaging in said indentations formed in the bottom surface of each of said caddies for transporting said caddies in a form-locking manner, wherein said openings formed in said conveyor belts are openings for receiving said arbors for cops and said arbors for empty tubes in alternation.

8. In a ring-spinning machine having rows of spindles disposed on both sides thereof at a given spindle spacing, an assembly for transporting empty tubes and cops, which comprises:

driven conveyor belts disposed alongside the rows of spindles of the ring-spinning machine, said conveyor belts being drivable for delivering empty tubes towards and moving cops away from the spindles, said conveyor belts having openings formed therein at a mutual spacing approximately corresponding to half the given spindle spacing;

a plurality of caddies each carrying an arbor for receiving an empty tube and an arbor for receiving a cop; each of said caddies having a length being less than the given spindle spacing; and each of said caddies having an indentation formed in a bottom surface thereof;

guide tracks extending along said conveyor belts for guiding said caddies on said conveyor belts;

driver members secured in at least every other one of said openings of said conveyor belts, said driver members engaging in said indentations formed in the bottom surface of each of said caddies for transporting said caddies in a form-locking manner, wherein said caddies comprise substantially rectangular base plates, said base plates having bores formed therein for receiving said arbors, said bores corresponding to said openings in said conveyor belts.

9. In ring-spinning machine having rows of spindles disposed on both sides thereof at a given spindle spacing, an assembly for transporting empty tubes and cops, which comprises:

driven conveyor belts disposed alongside the rows of spindles of the ring-spinning machine, said conveyor belts being drivable for delivering empty tubes towards and moving cops away from the spindles, said conveyor belts having openings formed therein at a mutual spacing approximately corresponding to half the given spindle spacing;

a plurality of caddies each carrying an arbor for receiving an empty tube and an arbor for receiving a cop; each of said caddies having a length being less than the given spindle spacing; and each of said caddies having an indentation formed in a bottom surface thereof;

guide tracks extending along said conveyor belts for guiding said caddies on said conveyor belts;

driver members secured in at least every other one of said openings of said conveyor belts, said driver members engaging in said indentations formed in the bottom surface of each of said caddies for transporting said caddies in a form-locking manner, transverse transport paths extending between said guide tracks and joining together said guide tracks for forming a closed loop, wherein said caddies have a given width, and including pusher means disposed at respective ends of said transverse transport paths for displacing said caddies onward in a transport direction by a distance corresponding to said width and to said length, respectively.

* * * * *